United States Patent [19]

Goineau

[11] Patent Number: 5,036,568

[45] Date of Patent: Aug. 6, 1991

[54] METHOD AND SYSTEM TO DETECT THE POSITION AND TENSION OF YARN BEING AIR TEXTURED

[75] Inventor: Andre M. Goineau, Spartanburg, S.C.

[73] Assignee: Milliken Research Corporation, Spartanburg, S.C.

[21] Appl. No.: 526,449

[22] Filed: May 21, 1990

[51] Int. Cl.[5] ..... D02G 1/18

[52] U.S. Cl. ..... 28/248; 242/36; 57/264

[58] Field of Search ..... 28/241, 248; 242/36; 57/81, 86, 264; 200/61.18

[56] References Cited

U.S. PATENT DOCUMENTS

| | | | |
|---|---|---|---|
| 3,807,270 | 4/1974 | Wirz | 28/241 X |
| 3,844,497 | 10/1974 | Harrill et al. | 200/61.18 X |
| 4,078,505 | 3/1978 | Fitton et al. | 200/61.18 X |
| 4,147,020 | 4/1979 | Oakes | 28/248 X |
| 4,361,777 | 11/1982 | Mettler | 200/61.18 X |
| 4,376,516 | 3/1983 | Leu | 242/36 |
| 4,404,791 | 9/1983 | Wolf et al. | 57/80 |
| 4,598,538 | 7/1986 | Moore, Jr. | 57/7 |
| 4,830,296 | 5/1989 | Ueda et al. | 242/36 X |
| 4,918,914 | 4/1990 | Eaton | 28/248 X |

FOREIGN PATENT DOCUMENTS

| | | | |
|---|---|---|---|
| 0036097 | 8/1986 | Japan | 28/248 |

*Primary Examiner*—Werner H. Schroeder
*Assistant Examiner*—John J. Calvert
*Attorney, Agent, or Firm*—Earle R. Marden; H. William Petry

[57] ABSTRACT

Method and apparatus to produce a plied, air textured continuous filament yarn by severing the supply yarn upon the detection of a drop in tension. When the tension in the yarn being processed drops, the position of the running yarn will be detected by a photocell unit which will actuate a cutter upon such detection to sever the yarns being supplied to the air texturing machine. The method and apparatus provide that the drop in tension has to occur for a predetermined length of time or occur a multiplicity of times before the cutter is actuated.

5 Claims, 3 Drawing Sheets

METHOD AND SYSTEM TO DETECT THE POSITION AND TENSION OF YARN BEING AIR TEXTURED

This invention relates generally to a method and apparatus to texture a continuous filament synthetic yarn and more specifically to an air texturing system which detects the position of a yarn being textured to ensure that the resultant air textured yarn is of a desired quality.

The yarn produced by the herein-disclosed system is for use in high quality fabrics that require a relatively high friction resistant surface that is not slick or shiny. Such fabrics are used for the production of numerous sports apparels such as ski wear.

It is, therefore, an object of the invention to produce a high quality, air textured, synthetic yarn which does not have slubs or other areas of unevenness therein which can be used to produce high quality fabrics having improved aesthetics and high surface friction resistance.

Other objects and advantages of the invention will become readily apparent as the specification proceeds to describe the invention with reference to the accompanying drawings, in which.

Figure 1:
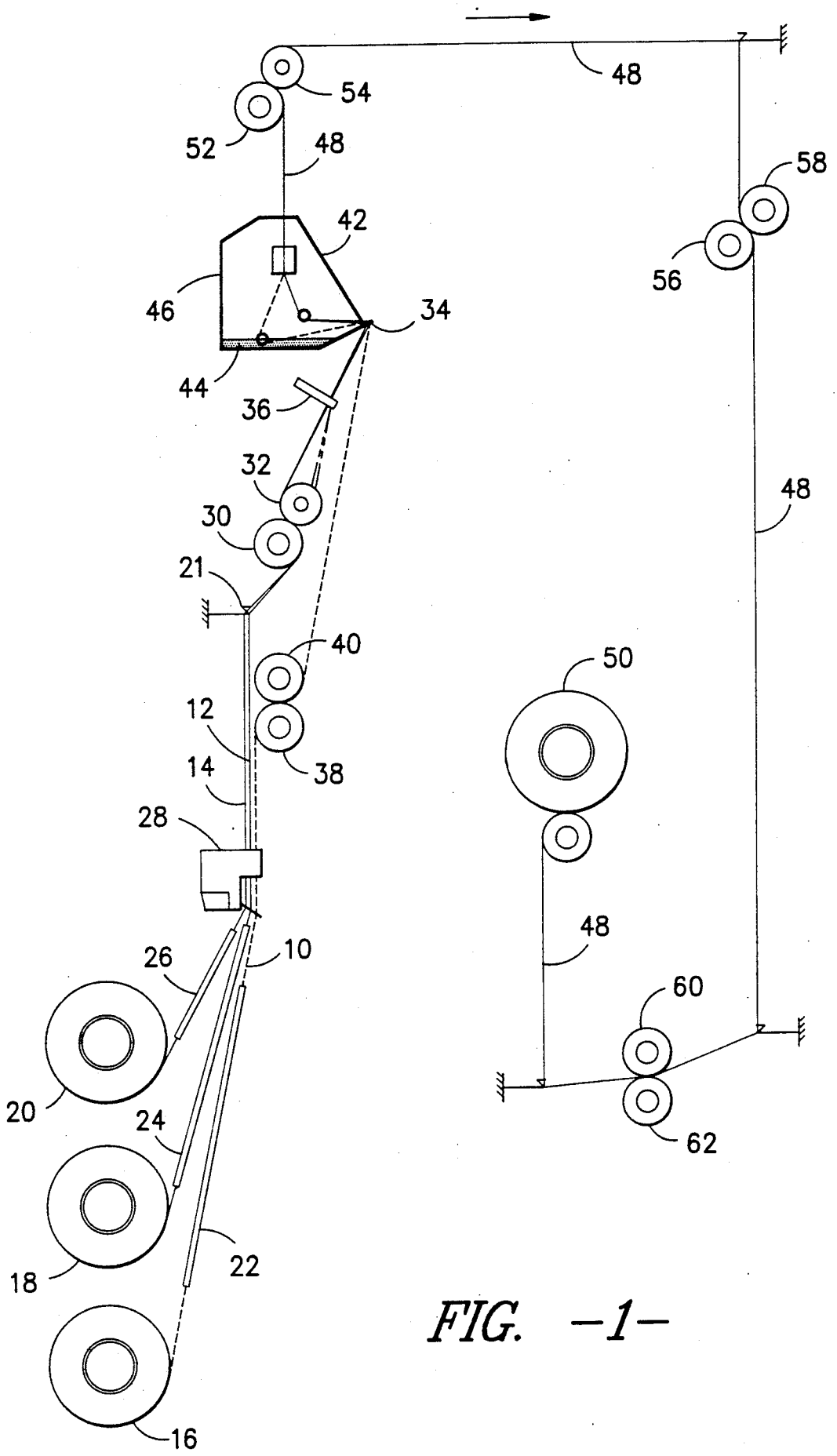
FIG. 1 is a schematic view of the new and improved air texturing system.

Looking now to FIG. 1, the overall process will be described. In the preferred form of the invention FOY polyester, 70 denier, 66 filament yarns 10, 12 and 14 are supplied from suitable packages 16, 18 and 20, respectively, through guide tubes 22, 24 and 26. The effect yarns 12 and 14 are delivered from the packages 18 and 20 in parallel relationship sequentially through the yarn cutter 28 and guide member 21 by driven rolls 30 and 32 to the yarn guide 34 through the yarn position detector 36 at a rate of 25 meters/minute. The core yarn 10 is delivered from the package 16 by the driven rolls 38 and 40 through the yarn cutter 28 to the yarn guide 34 at a rate of 200 meters/minute. From the yarn guide 34 the effect yarns 12 and 14 are plied and textured with the core yarn 10 in the air texturing jet 42, supplied with air at a pressure of approximately 130 p.s.i., after it has passed through the water 44 in the sump or water bath of the housing 46. From the air texturing jet 42 the 3-ply textured yarn 48 is delivered to the takeup package 50 sequentially through rolls 52, 54 driven at a speed to deliver yarn at a rate of 188 meters/minute, rolls 56, 58 driven at a rate to deliver yarn at a rate of 200 meters/-minute and rolls 60, 62 driven at a rate to deliver yarn 48 at 194 meters/minute to the package 50 whereat it is taken up at a rate of 192 meters/minute.

In the production of the disclosed type of yarn it is essential to maintain the desired correct tension in the effect yarns 12 and 14 or, otherwise, slubs will be formed in the textured 3-ply yarn 42 resulting in an undesired surface effect in the fabric produced therefrom. Therefore, the herein disclosed includes a system to detect low tension effect yarn and sever the supply of such yarn before a large quantity of off-quality yarn is produced.

Figure 2:
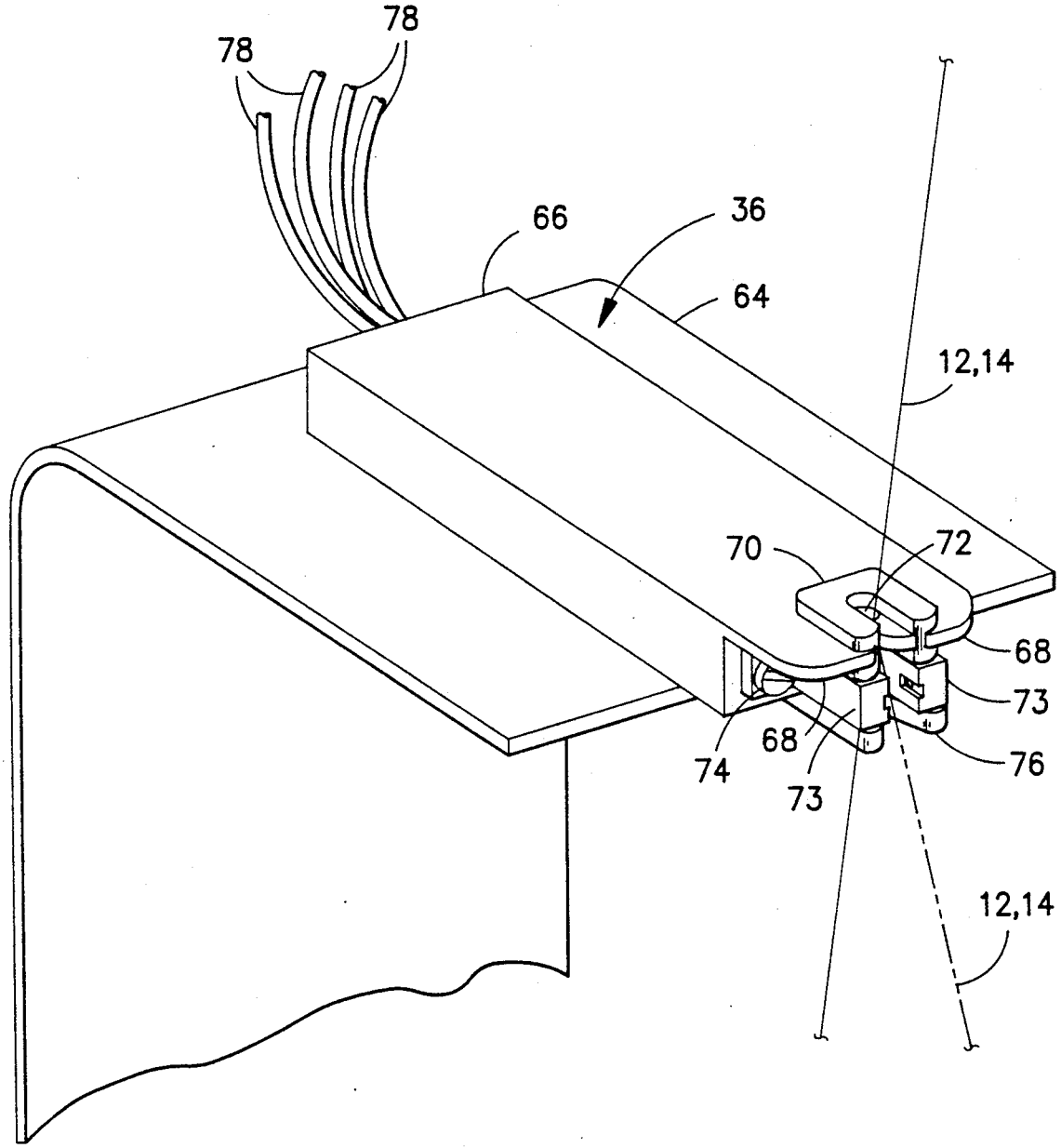
FIG. 2 is a blown up perspective view of the yarn position detector.
Figure 3:
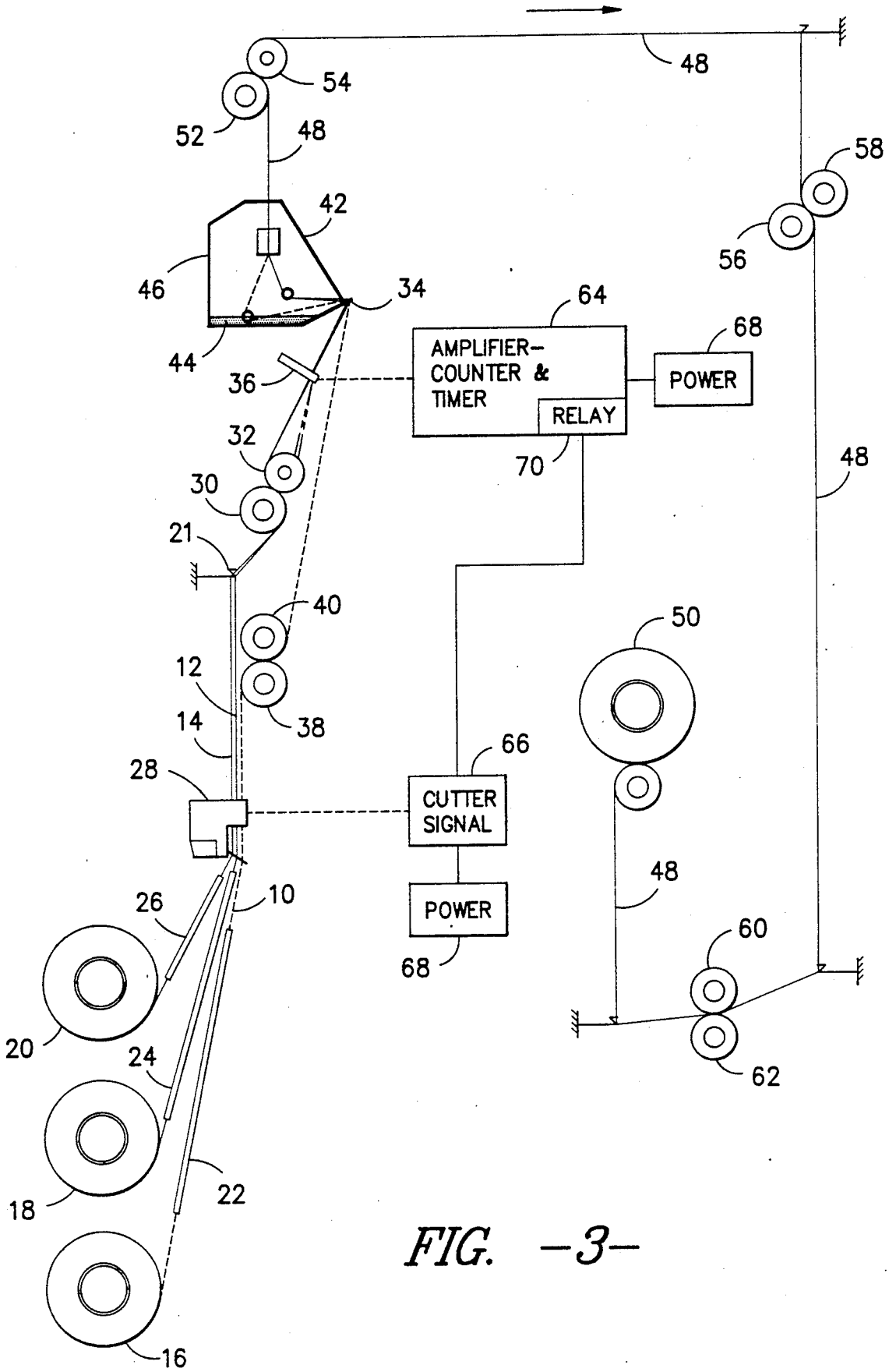
FIG. 3 is a modification of FIGS. 1 and 2.

As discussed briefly before, the effect yarns 12 and 14 are threaded and pass through the yarn position detector 36, shown in detail in FIG. 2. The detector 36 is mounted on a plate 64 which is mounted at each thread position on a yarn producing frame so the yarns 12 and 14 when, under the correct tension, run, as shown in solid lines in FIGS. 1 and 2. Looking at the drawings, and FIG. 2 in particular, the yarn position detector consists of a body member 66 having elongated prongs 68 between which is mounted a ceramic guide 70 with a yarn hole 72 therein. Below the ceramic guide 70, a photocell detection unit 73 is secured to the body member 66 by suitable screws 74 and having its detection device outward from the yarn hole 72. Mounted below and to the detection unit is another ceramic guide 76. The photocell detection unit 73 is electrically connected to source of power and the yarn cutter 28 by suitable wiring 78.

In normal operation the effect yarns 12, 14 (indicated by the solid line in FIG. 2) runs straight through the yarn hole 72 in the yarn guide 70. If the tension in the yarns 12, 14 drops below a predetermined level the yarns or yarns 12, 14 will tend to move outward as indicated by the dotted lines. When the tension drops below a certain level the yarns 12, 14 will break the light path of the photocell detection unit causing a signal to be sent to the cutter 20 to activate same and cause the cutter 20 to sever the yarns 10, 12 and 14 being supplied from the packages 16, 18 and 20 to prevent the further production of lower quality slubby yarn.

The form of the invention shown in FIGS. 1 and 2 will cut the yarn whenever the yarn tension drops below a pre-determined minimum. It has been found that the drop of yarn tension may be only momentary and not due to breakage of a yarn end or malfunction of the machine. In such cases it is not necessary to cut the yarn. To alleviate the unnecessary severing of the yarn, a combination amplifier-counter-timer 84 is connected to the detector 36 to provide a signal to the cutter signal device 86 when it is desired to cut the yarn. Each of the devices 84 and 86 have a separate power source 88 isolated by one another by a mechanical relay 90. The amplifier-counter-timer 84 can be set to deliver a signal to the cutter signal device 86 only when the detector has detected a plurality of yarn tension lowerings in a predetermined length of time. This will eliminate the unnecessary cutting of the yarn resulting in wasted production and production time.

The use of the yarn position detector 36 in combination with the cutter 20 essentially eliminates the production of off-quality yarns with slubs therein. It also tends to allow optimum production speeds with extended cleaning cycles. Other advantages are obtained when off-quality yarn is not detected and is used in the production of woven or knitted fabrics.

Although the preferred embodiments of the invention have been specifically described, it is contemplated that changes may be made without departing from the scope or spirit of the invention and it is desired that the invention be limited only by the scope of the claims.

I claim:

1. A method of producing a textured plied yarn from a plurality of continuous filament yarns comprising the steps of: supplying a core yarn from a supply package to an air texturing jet through a yarn cutter, supplying an effect yarn from a supply package to the same air texturing jet as the core yarn sequentially through the yarn cutter and a yarn position detector, plying and texturing the core and effect yarns in the air texturing jet, taking up the plied and textured yarn and actuating the yarn cutter to cut the core and effect yarns when the yarn position detector detects that the tension in the effect yarn has dropped below a pre-determined minimum a pre-determined number of times in a pre-determined length of time.

2. The method of claim 1 wherein said core and effect yarns are fully oriented yarns.

3. The method of claim 2 wherein the yarn position detector includes a photocell detection unit which supplies a signal to the yarn cutter when the effect yarn interrupts the light in the photocell unit.

4. A system to produce an air textured continuous filament yarn comprising: at least two yarn supplies, an air texturing jet, a photoelectric yarn position detector, a yarn cutter, a means to supply yarn from one of said yarn supplies to said air texturing jet through said yarn cutter, a second means to supply yarn from the other of said yarn supplies to said air texturing jet through said yarn cutter and said yarn position detector, means operably associated with said yarn cutter and said yarn position detector to actuate said yarn cutter to cut said yarns when the tension of the yarn in said detector falls below a predetermined minimum a pre-determined number of times in a pre-determined length of time, means to supply air to said air texturing jet to ply and texture said yarns and means to take up the plied and textured yarns.

5. The system of claim 4 wherein said yarns from said yarn supplies are fully oriented yarns.

* * * * *